United States Patent [19]

Hampton et al.

[11] Patent Number: 4,666,225

[45] Date of Patent: May 19, 1987

[54] ELECTRICAL JACK

[75] Inventors: Clifton G. Hampton, Bedford; Thomas A. Dellinger, N. Richland Hills, both of Tex.

[73] Assignee: Siecor Corporation, Hickory, N.C.

[21] Appl. No.: 830,742

[22] Filed: Feb. 19, 1986

[51] Int. Cl.[4] ..... H01R 13/44

[52] U.S. Cl. ..... 339/42; 339/40

[58] Field of Search ..... 339/40, 42, 43

[56] References Cited

U.S. PATENT DOCUMENTS

| | | | |
|---|---|---|---|
| 1,621,364 | 3/1927 | Goodridge | 339/43 |
| 3,865,456 | 2/1975 | Dola | 339/40 |
| 4,040,698 | 8/1977 | Ortiz | 339/40 |
| 4,188,082 | 2/1980 | Dickey | 339/36 |
| 4,528,429 | 7/1985 | Dobson et al. | 339/43 |
| 4,592,609 | 6/1986 | Kasai et al. | 339/42 |

FOREIGN PATENT DOCUMENTS

| | | | |
|---|---|---|---|
| 1202374 | 10/1965 | Fed. Rep. of Germany | 339/42 |

*Primary Examiner*—Eugene F. Desmond
*Assistant Examiner*—Paula A. Austin
*Attorney, Agent, or Firm*—Roy B. Moffitt; J. David Abernethy

[57] ABSTRACT

An electrical jack having a jack door biased so as to block the opening of a passage within the jack housing when the jack is not in use and which unblocks the passage in response to insertion of a plug within the passage. The jack door may contain slots for slideably receiving electrical contacts embedded in a dielectric body within the housing. When a plug is inserted the electrical contacts engage electrically with the plug. Upon removal of the plug the jack door is urged to reblock the passage.

1 Claim, 7 Drawing Figures

ELECTRICAL JACK

BACKGROUND OF THE INVENTION

1. Field of the Invention

This invention relates to the field of electrical connectors, particularly telephone wall jacks.

2. Description of the Related Art

The direction of electrical technology today is toward smaller, modular components. So-called modular telephone jacks are described in U.S. Pat. No. 4,188,082 to Dickey; the disclosure of which is incorporated herein by reference as if completely reproduced herein. U.S. Pat. No. 4,188,082 discloses the problem of foreign objects, including dust and children's fingers, being introduced into telephone wall jacks by air currents or otherwise. Disclosed therein is a gate biased by a spring to close the jack opening when it is not in use. It must be opened by manually moving the gate. However, an electrical appliance which connects directly to the jack, instead of by a plug attached to a cord, cannot be used in this prior art device because the biased gate cannot be opened while the appliance, such as a wall telephone, is being mounted on the wall jack.

SUMMARY OF THE INVENTION

The jack housing of the present invention is not only self-closing, as in Dickey, U.S. Pat. No. 4,188,082, but is also capable of being opened without manual opening of a tab such as tab 18 in Dickey. The requirement of manual movement of the Dickey tab renders mounting of appliances such as a wall telephone difficult, if not impossible, because the tab cannot be manually held open at the same time the appliance is mounted. In the present invention the user opens the passage in the housing by pressing the appliance plug itself against the jack door. The appliance plug pushes the jack door to unblock the passage. Moving the jack door may expose contact members slideably received in slots within the jack door, allowing electrical and mechanical engagement of the appliance plug and the contact members. When the plug is removed, a biasing means such as a spring or any other physical or electromagnetic force pushes the jack door to again block the passage. The invention may be mounted so the door falls to the original position when the plug is removed. An arm on the jack door may contact the housing to stop the door in the first position. The housing may have opposite shoulders which form a portion of the walls of the passage to guide the jack door as it slides between the front and rear of the passage. A spring between the jack door and a wall forming a portion of the passage in the jack housing may be used to bias or push the jack door to the front of the passage when the plug is removed, the spring being disposed between the wall and the jack door. The jack door may also be mounted on a hinge at the front of the passage. Of course, an ordinary modular jack plug attached to a cord may also be used with the present invention.

It is an object of the present invention to allow the use of wall mounted electrical appliances, such as telephones, to be used in a self-closing wall jack.

DESCRIPTION OF THE PREFERRED EMBODIMENT

Figure 1:
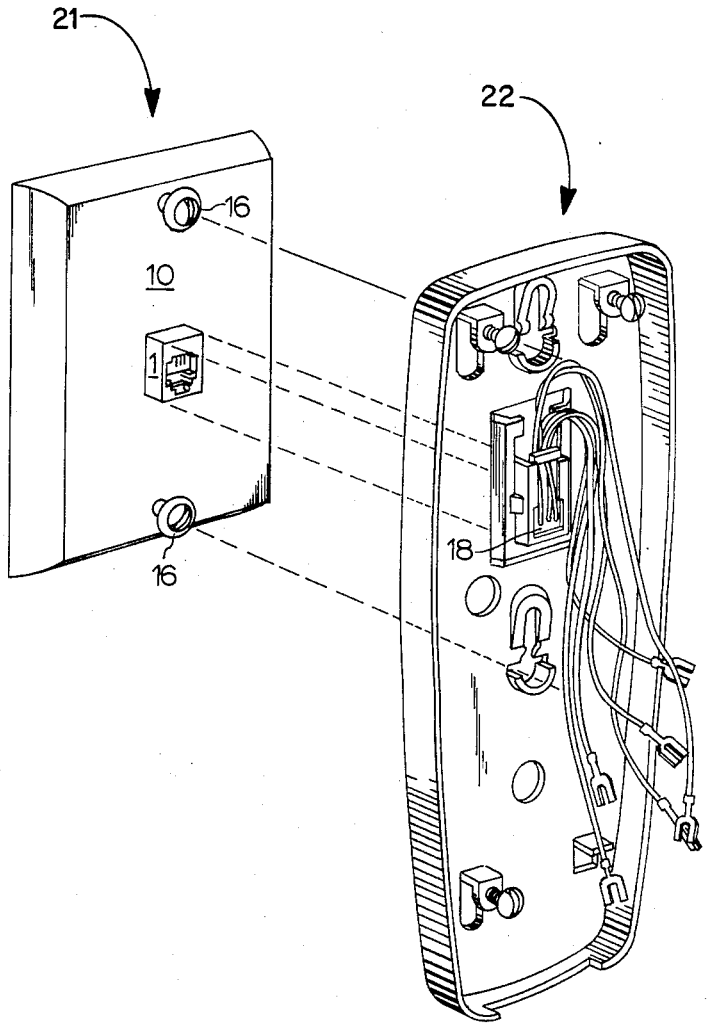
FIG. 1 is a perspective view of the housing and a cover plate, Element 1, in association with an applicance to be mounted thereon, Element 2.

FIG. 1 shows element 22, a wall mounted appliance, to be mounted on element 21, housing 1 mounted on cover plate 10. Screws 16 attach cover plate 10 to a base plate (not shown) mounted on a wall. Housing 1 contains passage 17 (shown in FIGS. 4 and 6) for receiving plug 18, the back of which is shown in element 22.

Figure 2:
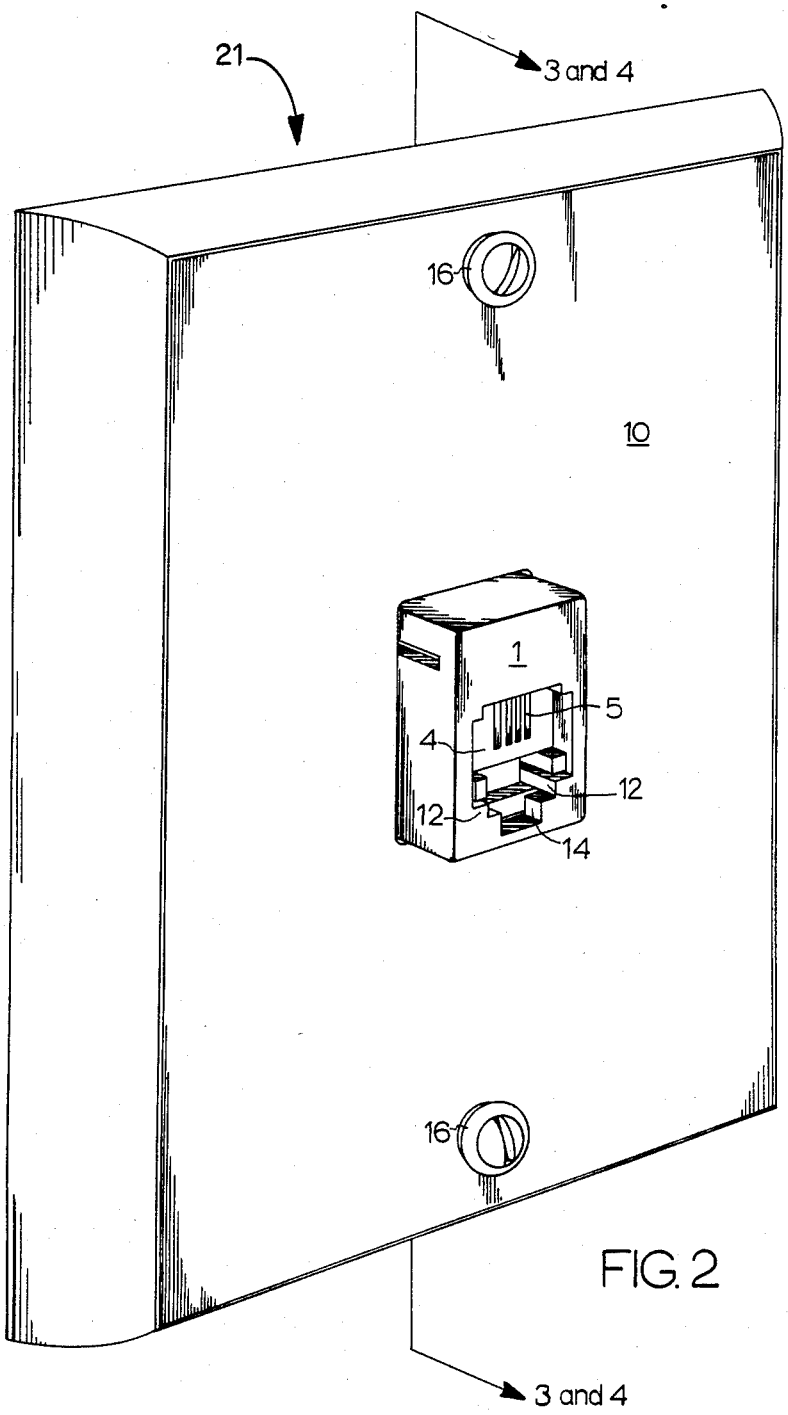
FIG. 2 is a detailed perspective view of Element 1 of FIG. 1 showing the housing protruding from a cover plate and the first embodiment of the door within the jack housing.

FIG. 2 is a detailed perspective view of element 21 of FIG. 1. Housing 1 is circumscribed by cover plate 10. The first embodiment of door 4 is disposed in passage 17 (shown in FIGS. 4 and 6) formed by housing 1 and is adapted to move slideably within the passage delimited by housing 1 and on the laterally extended shoulders 12 of jack housing 1. Door 4 fits around and slides on shoulders 12 and wall members 5 of door 4 form slots to accommodate the contact members 3 (shown in FIGS. 3, 4, 6). Housing 1 contains an area 14 extending in front of a portion of door 4.

Figure 3:
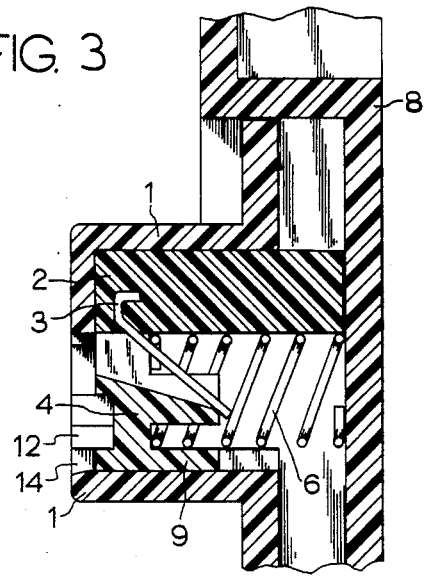
FIG. 3 is a side cross-sectional view of the housing with the first embodiment of the door in the first position.
Figure 4:
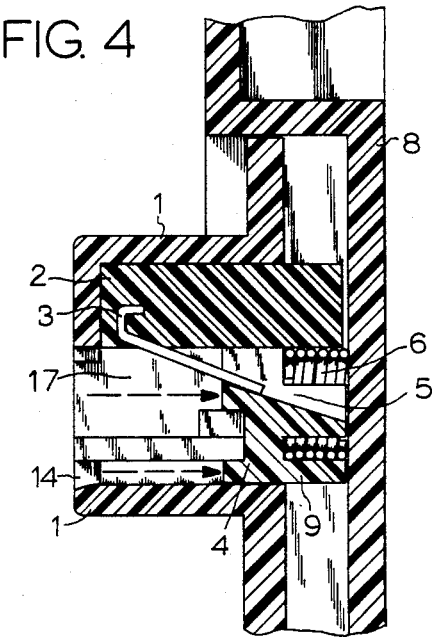
FIG. 4 is a side cross-sectional view of the housing with the first embodiement of the door in the second position.
Figure 6:
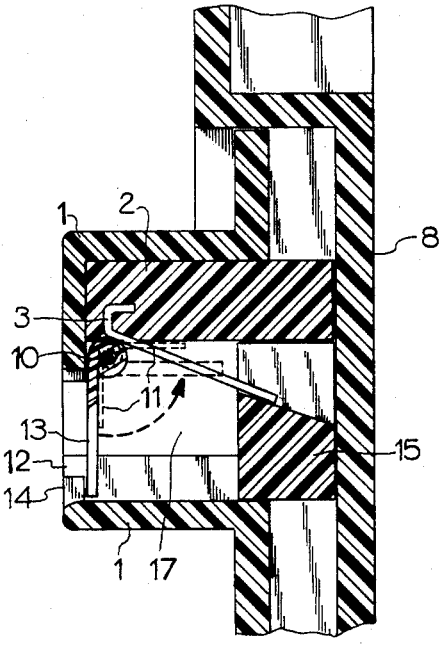
FIG. 6 is a corresponding side cross sectional view of the second embodiment of the door hingeably mounted at the front of the passage.

FIG. 3 shows the first embodiment of the invention with door 4 in the first, closed position blocking the front of passage 17 (shown in FIGS. 4 and 6). Housing 1 contains dielectric body 2. Contact member 3 is embedded in dielectric body 2 and extends into passage 17. The embedded portion of contact member 3 may be coupled to other electrical conductors (not shown). Passage 17 is partially delimited by a back wall 8. Spring 6 is disposed between the back wall 8 and door 4 and urges or pushes jack door 4 to the front of the passage 17.

FIG. 4 shows the first embodiment with door 4 pushed by a plug (not shown) to the second position at the rear of passage 17. Force is being applied by the plug, not shown, inserted within passage 17 to compress spring 6. Note that contact member 3 shown, along with any other similar contact members, is now exposed, having penetrated a slot formed by walls 5 in door 4, to make electrical and mechanical connection with a similar type contact in the plug. Contact members such as contact 3 are sometimes called tangs. The direction of movement of the door 4 from the first to the second position in response to insertion of the plug is as shown by the dashed arrows.

Figure 5:
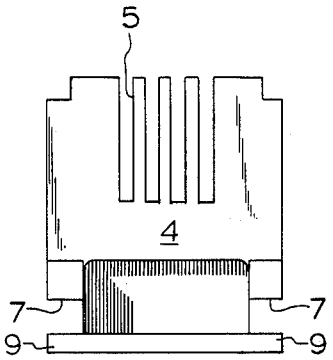
FIG. 5 is a plan view of the first embodiment of the door having surfaces to accommodate shoulders in the housing, upstanding wall members forming slots, and an arm.

FIG. 5 shows door 4 of the first embodiment in isolation, to show arm 9, wall members 5, and surfaces 7 which are carried by shoulders 12. Arm 9 acts as a stop when the jack door slides back into the first position by contacting area 14 of housing 1 shown in FIG. 2.

FIG. 6 shows the operation of the second preferred embodiment of the invention. Door 13 is hingably mounted at the front of passage 17 and moves on hinge 10 from the first position shown in solid lines, blocking the passage, to the second position, shown by dashed lines, in response to insertion of a plug, not shown. The upward curving dotted arrow is a directional arrow describing door 13's direction of movement from the first to the second position. Spring 11 urges door 13 back to the first position upon removal of the plug. Contact member 3 may rest on or be held by dielectric member 15.

Figure 7:
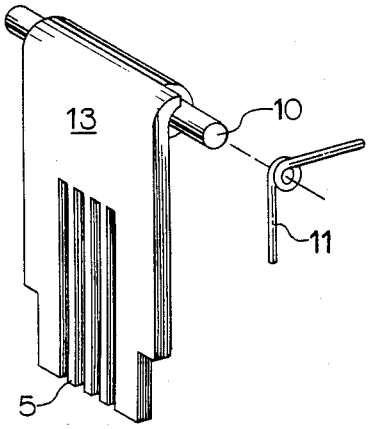
FIG. 7 is an expanded view of the second embodiment of the door and spring.

FIG. 7 shows the details of the door 13, hinge 10, upstanding wall members 5, and spring 11 of the second embodiment of the invention in greater detail for ease of comprehension. A similar spring could be placed on the opposite side of hinge 10.

Further information regarding the configuration of electrical components in the overall wall jack may be found in Dickey, U.S. Pat. No. 4,188,082, issued Feb. 12, 1980, incorporated herein by reference as if fully set out.

What is claimed is:

1. An electrical jack comprising:

(a) a housing having a cavity therein open to the surface of the housing;

(b) a dielectric member within the cavity mounted on the housing, a portion of the cavity not occupied by the dielectric member forming a passage for receiving an electrical plug therein;

(c) an electrical contact member mounted on the dielectric member having a free end extending into the passage for making an electrical connection with the electrical plug when the electrical plug is inserted within the passage;

(d) a slotted door slideably mounted within the passage adapted to be pushed by the electrical plug from a first position at the front of the passage blocking the passage to a second position at the rear of the passage adapted to allow a portion of the contact member to penetrate at least one slot in the slotted door and make electrical contact with the plug when the plug is inserted within the passage; and (e) a spring within the passage for urging the door to the first position.

* * * * *